US010803819B2

(12) United States Patent
Hu

(10) Patent No.: US 10,803,819 B2
(45) Date of Patent: Oct. 13, 2020

(54) DRIVING METHOD AND DRIVING APPARATUS OF DISPLAY PANEL, AND DISPLAY APPARATUS

(71) Applicants: HKC Corporation Limited, Shenzhen (CN); Chongqing HKC Optoelectronics Technology Co., ltd., Chongqing (CN)

(72) Inventor: Yun Chuan Hu, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 16/338,504

(22) PCT Filed: Sep. 20, 2017

(86) PCT No.: PCT/CN2017/102461
§ 371 (c)(1),
(2) Date: Apr. 1, 2019

(87) PCT Pub. No.: WO2019/019312
PCT Pub. Date: Jan. 31, 2019

(65) Prior Publication Data

US 2020/0027410 A1 Jan. 23, 2020

(30) Foreign Application Priority Data

Jul. 24, 2017 (CN) ..... 2017 1 0606538

(51) Int. Cl.
*G09G 3/36* (2006.01)

(52) U.S. Cl.
CPC ..... *G09G 3/3607* (2013.01); *G09G 3/3614* (2013.01); *G09G 2300/0452* (2013.01);
(Continued)

(58) Field of Classification Search
CPC ... G09G 2300/0452; G09G 2310/0202; G09G 2320/02; G09G 2320/0233; G09G 3/36;
(Continued)

(56) References Cited

U.S. PATENT DOCUMENTS

2011/0122119 A1* 5/2011 Bae ..... G09G 3/3233 345/211
2012/0169780 A1* 7/2012 Park ..... G09G 5/10 345/690

(Continued)

*Primary Examiner* — Richard J Hong
(74) *Attorney, Agent, or Firm* — WPAT, PC

(57) ABSTRACT

A driving method and a driving apparatus of a display panel and a display apparatus are provided. A position information of a current sub-pixel and a driving data for driving the current sub-pixel are obtained. A judgment parameter corresponding to the position information is found from a first parameter look-up table. The driving data whether needs to be compensated is determined. A compensation driving data corresponding to the driving data is found from a second parameter look-up table corresponding to the position information if it needs to be compensated, or else the driving data is directly outputted. Bright and dark stripes or grid phenomenon in a liquid crystal display panel can be effectively eliminated consequently.

12 Claims, 5 Drawing Sheets

(52) U.S. Cl.
CPC ..... *G09G 2310/0202* (2013.01); *G09G 2320/0233* (2013.01)

(58) Field of Classification Search
CPC ..... G09G 3/3607; G09G 3/3614; G09G 5/10; G09G 3/344; G09G 3/3648; G09G 3/3413; G09G 3/3233; H04N 9/68
See application file for complete search history.

(56) References Cited

U.S. PATENT DOCUMENTS

| | | | | |
|---|---|---|---|---|
| 2012/0249508 | A1* | 10/2012 | Hsu | G09G 3/344 345/211 |
| 2017/0041507 | A1* | 2/2017 | Chen | H04N 9/68 |
| 2017/0076675 | A1* | 3/2017 | Hatanaka | G09G 3/3648 |
| 2017/0193929 | A1* | 7/2017 | Chen | G09G 3/3607 |
| 2018/0033382 | A1* | 2/2018 | Tomizawa | G09G 3/3413 |
| 2018/0182321 | A1* | 6/2018 | Zeng | G09G 3/3607 |

* cited by examiner

| R | G | B | R | G | B | R | G | B | R | G | B |
|---|---|---|---|---|---|---|---|---|---|---|---|
| 0 | 1 | 0 | 1 | 0 | 1 | 0 | 1 | 0 | 1 | 0 | 1 |
| 0 | 1 | 0 | 1 | 0 | 1 | 0 | 1 | 0 | 1 | 0 | 1 |

| 0 | 1 | 2 | …… | 154 | 255 |
|---|---|---|---|---|---|
| R（0） | R（1） | R（2） | …… | R（254） | R（255） |

| 0 | 1 | 2 | …… | 154 | 255 |
|---|---|---|---|---|---|
| G（0） | G（1） | G（2） | …… | G（254） | G（255） |

| 0 | 1 | 2 | …… | 154 | 255 |
|---|---|---|---|---|---|
| B（0） | B（1） | B（2） | …… | B（254） | B（255） |

DRIVING METHOD AND DRIVING APPARATUS OF DISPLAY PANEL, AND DISPLAY APPARATUS

FIELD OF THE DISCLOSURE

The disclosure relates to the field of display technology, and more particularly to a driving method of a display panel, a driving apparatus of a display panel and a display apparatus.

BACKGROUND

With continuing development of display technology, display equipments such as liquid crystal panels and monitors continue to develop towards directions of being slim, large screen, low power consumption and low cost. At present, a dual-gate driving architecture is widely used for driving the liquid crystal display panel, compared with a traditional driving architecture, the number of gate lines of the dual-gate driving architecture is doubled and the number of data lines is reduced by half, so that the number of source driver ICs correspondingly is reduced and thus the manufacturing cost is reduced.

However, because the number of gate lines is doubled, a data writing time of each row of sub-pixels in the dual-gate driving architecture is halved, when driving polarities are reversed, sub-pixels whose polarities are reversed may have insufficient liquid crystal charging times due to data delay, so that the liquid crystal display panel appears bright and dark stripes or grid phenomenon.

SUMMARY

Embodiments of the disclosure provide a driving method and a driving apparatus of a display panel and a display apparatus, so as to address the issue that since the number of gate lines is doubled, a data writing time of each row of sub-pixels in the dual-gate driving architecture is halved, when driving polarities are reversed, sub-pixels whose polarities are reversed may have insufficient liquid crystal charging times due to data delay, and the liquid crystal display panel would appear bright and dark stripes or grid phenomenon In particular, in a first aspect, a driving method of a display panel according to an embodiment of the disclosure includes: obtaining a position information of a current sub-pixel and a driving data for driving the current sub-pixel; looking-up (i.e., generally finding, searching) a judgment parameter corresponding to the position information from a first parameter look-up table according to the position information; outputting the driving data if the judgment parameter is a first parameter; looking-up a compensation driving data from a second parameter look-up table according to the position information and the driving data and outputting the compensation driving data if the judgment parameter is a second parameter, wherein the second parameter look-up table is corresponding to the position information, and the compensation driving data is corresponding to the driving data.

In an embodiment, the second parameter look-up table includes a first compensation parameter look-up table, a second compensation parameter look-up table, and a third compensation parameter look-up table.

In an embodiment, the step of looking-up a compensation driving data from a second parameter look-up table according to the position information and the driving data and outputting the compensation driving data includes: finding the compensation driving data from the first compensation parameter look-up table and outputting the compensation driving data, if the sub-pixel corresponding to the position information is a first color sub-pixel; looking-up the compensation driving data from the second compensation parameter look-up table and outputting the compensation driving data, if the sub-pixel corresponding to the position information is a second color sub-pixel; looking-up the compensation driving data from the third compensation parameter look-up table and outputting the compensation driving data, if the sub-pixel corresponding to the position information is a third color sub-pixel.

In an embodiment, the display panel includes at least one sub-pixel unit, and each sub-pixel unit includes m rows×n columns of sub-pixels; the at least one sub-pixel unit is regularly arranged to constitute a pixel array including M rows×N columns of sub-pixels; the first parameter look-up table is formed by m rows×n columns of judgment parameters, the sub-pixels in the sub-pixel unit are corresponding to the judgment parameters in the first parameter look-up table in one-to-one manner as per arrangement positions; where $M \geq m \geq 1$, $N \geq n \geq 1$, and M, N, m and n all are positive integers.

In an embodiment, each row of sub-pixels in the pixel array include a plurality of groups of sub-pixels; each group of sub-pixels include a first color sub-pixel, a second color sub-pixel and a third color sub-pixel arranged in sequence; colors of the sub-pixels in a same column are the same; the first color sub-pixel, the second color sub-pixel and the third color sub-pixel include at least red sub-pixel, at least one green sub-pixel and at least one blue sub-pixel.

Moreover, in a second aspect, a driving apparatus of a display panel according to an embodiment of the disclosure includes: a data obtaining module, configured to obtain a position information of a current sub-pixel and a driving data for driving the current sub-pixel; a judgment parameter lookup module, configured to look-up a judgment parameter corresponding to the position information from a first parameter look-up table according to the position information; an outputting module, configured to output the driving data if the judgment parameter is a first parameter; and a compensation parameter lookup module, configured to look-up a compensation driving data from a second parameter look-up table according to the position information and the driving data and outputting the compensation driving data if the judgment parameter is a second parameter, wherein the second parameter look-up table is corresponding to the position information, and the compensation driving data is corresponding to the driving data.

In an embodiment, the second parameter look-up table includes a first compensation parameter look-up table, a second compensation parameter look-up table and a third compensation parameter look-up table. The compensation parameter lookup module includes: a first color sub-pixel compensation parameter lookup unit, configured to look-up the compensation driving data from the first compensation parameter look-up table and outputting the compensation driving data, if the sub-pixel corresponding to the position information is a first color sub-pixel; a second color sub-pixel compensation parameter lookup unit, configured to look-up the compensation driving data from the second compensation parameter look-up table and outputting the compensation driving data, if the sub-pixel corresponding to the position information is a second color sub-pixel; and a third color sub-pixel compensation parameter lookup unit, configured to look-up the compensation driving data from the third compensation parameter look-up table and outputting the compensation driving data, if the sub-pixel corresponding to the position information is a third color sub-pixel.

In an embodiment, the display panel includes at least one sub-pixel unit, and each sub-pixel unit includes m rows×n columns of sub-pixels; the at least one sub-pixel unit is regularly arranged to constitute a pixel array including M rows×N columns of sub-pixels; the first parameter look-up table is formed by m rows×n columns of judgment parameters, the sub-pixels in the sub-pixel unit are corresponding to the judgment parameters in the first parameter look-up table in one-to-one manner as per arrangement positions; where M≥m≥1, N≥n≥1, and M, N, m and n all are positive integers.

In an embodiment, each row of sub-pixels in the pixel array include a plurality of groups of sub-pixels; each group of sub-pixels include a first color sub-pixel, a second color sub-pixel and a third color sub-pixel arranged in sequence; colors of the sub-pixels in a same column are the same; the first color sub-pixel, the second color sub-pixel and the third color sub-pixel include at least red sub-pixel, at least one green sub-pixel and at least one blue sub-pixel.

In addition, in a third aspect, a display apparatus according to an embodiment of the disclosure includes: a display panel and any one of the driving apparatuses.

The embodiments of the disclosure obtain the position information of the current sub-pixel and the driving data for driving the current sub-pixel, find the judgment parameter corresponding to the position information from the first parameter look-up table and determine the driving data whether needs to be compensated according to the judgment parameter. If the driving data is needed to be compensated, the compensation driving data corresponding to the driving data will be found/searched from the second parameter look-up table corresponding to the position information and then the compensation driving data is outputted; or else the driving data without compensation is directly outputted. As a result, bright and dark stripes or grid phenomenon of the liquid crystal display panel can be effectively eliminated.

BRIEF DESCRIPTION OF THE DRAWINGS

In order to more clearly illustrate technical solutions of embodiments of the disclosure, drawings to be used in the description of the embodiments will be briefly described. Apparently, the drawings in the description below are merely some embodiments of the disclosure, a person skilled in the art can obtain other drawings according to these drawings without creative efforts.

DETAILED DESCRIPTION OF EMBODIMENTS

In order to make those skilled in the art better understand solutions of the disclosure, technical solutions in embodiments of the disclosure will be clearly and completely described below in conjunction with accompanying drawings of the disclosure. Apparently, the described embodiments are only some of embodiments of the disclosure rather than all of the embodiments. Based upon the described embodiments of the disclosure, all other embodiments obtained by those skilled in the art without creative effects should be within the scope of protection of the disclosure.

Terms "including/comprising" and their variations in the specification and claims of the disclosure and the above mentioned drawings are intended to cover non-exclusive inclusion. For example, a process, a method, a system, a product, and/or equipment including a series of steps or units is not limited to steps or units as listed and may optionally include steps or units not listed, or may alternatively include other steps or units inherent to these processes, methods, products or equipments. In addition, the terms "first," "second," and "third" and the like are used to distinguish different objects, rather than to describe a particular order.

Figure 1:
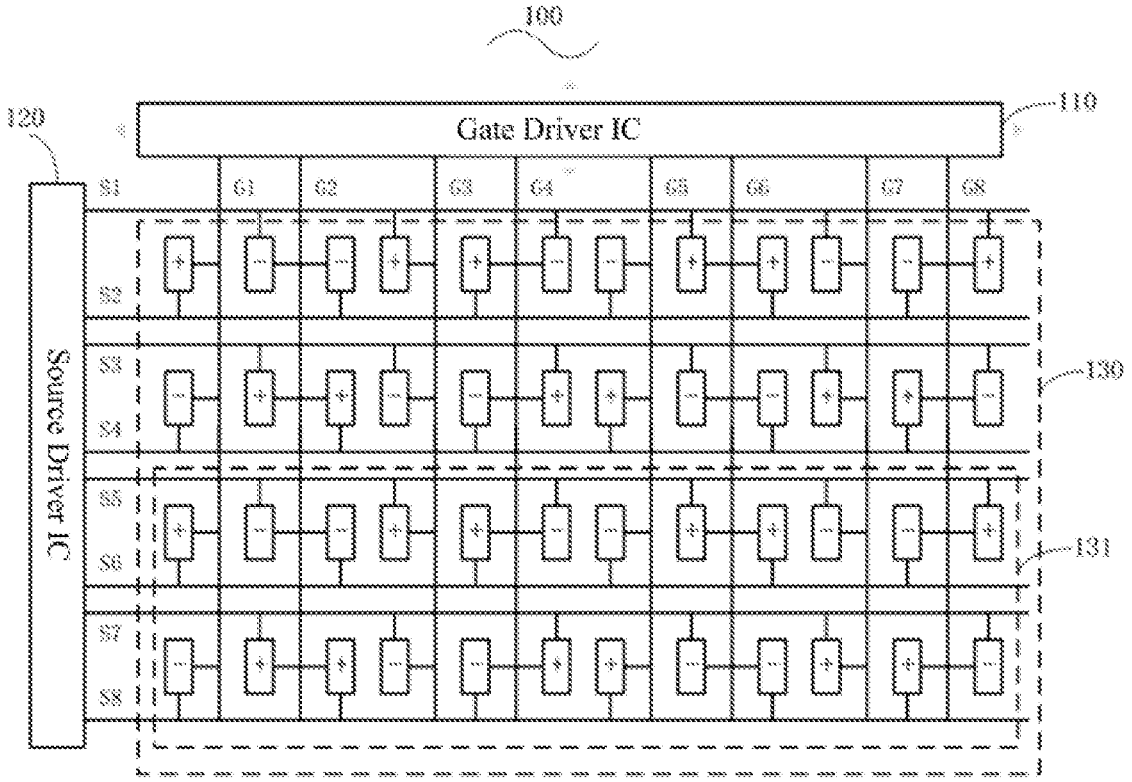
FIG. 1 is a schematic view of a display panel based on a dual-gate driving architecture according to an embodiment of the disclosure.

Referring to FIG. 1, a display panel 100 based on a dual-gate driving architecture provided by an embodiment of the disclosure includes at least one sub-pixel unit 131. The sub-pixel unit 131 includes m rows×n columns of sub-pixels. The at least one sub-pixel unit 131 is/are regularly arranged to constitute a pixel array 130 including M rows×N columns of sub-pixels. In the pixel array 130, the M rows of sub-pixels are driven by a source driver IC 120, and the N columns of sub-pixels are driven by a gate driver IC 110, where M≥m≥1, N≥n≥1, and M, N, m and n all are positive integers.

In a specific application, each row of sub-pixels in the pixel array includes multiple (i.e., more than one) groups of sub-pixels. Each group of sub-pixels includes a first color sub-pixel, a second color sub-pixel and a third color sub-pixel arranged in sequence. Colors of the sub-pixels in a same column are the same. The first color sub-pixel, the second color sub-pixel and the third color sub-pixel include at least one red sub-pixel, at least one green sub-pixel and at least one blue sub-pixel.

In an embodiment of the disclosure, the display panel uses the dual-gate driving architecture cooperative with a two-line inversion manner, and therefore in each group of sub-pixels, it must be that polarities of adjacent two sub-pixels are a first polarity and a polarity of another sub-pixel is a second polarity. One of the first polarity and the second polarity is positive polarity and the other one is negative polarity. In a same row of sub-pixels, the polarity of every two sub-pixels is reversed once. In a same column of sub-pixels, the polarities of adjacent sub-pixels are different.

In a specific application, based on the dual-gate driving architecture cooperative with two-line inversion manner, a row number of the sub-pixels included in each sub-pixel unit is m=2, a color arrangement manner and a polarity arrangement manner of each sub-pixel unit in the pixel array is same as the color arrangement manner and the polarity arrangement manner of the other sub-pixel unit.

FIG. 1 exemplarily illustrates a pixel array 130 where M=4, N=12, m=2 and n=12, that is, illustrates a pixel array including 4 rows (denoted as S1~S4 in the figure)×12 columns (denoted as G1~G12 in the figure) of sub-pixels. The first color sub-pixel is a red sub-pixel, the second color sub-pixel is a green sub-pixel, and the third color sub-pixel is a blue sub-pixel. In FIG. 1, "+" represents the positive polarity, "−" represents the negative polarity, R represents the red sub-pixel, G represents the green sub-pixel, and B represents the blue sub-pixel.

Figures 2, 3:
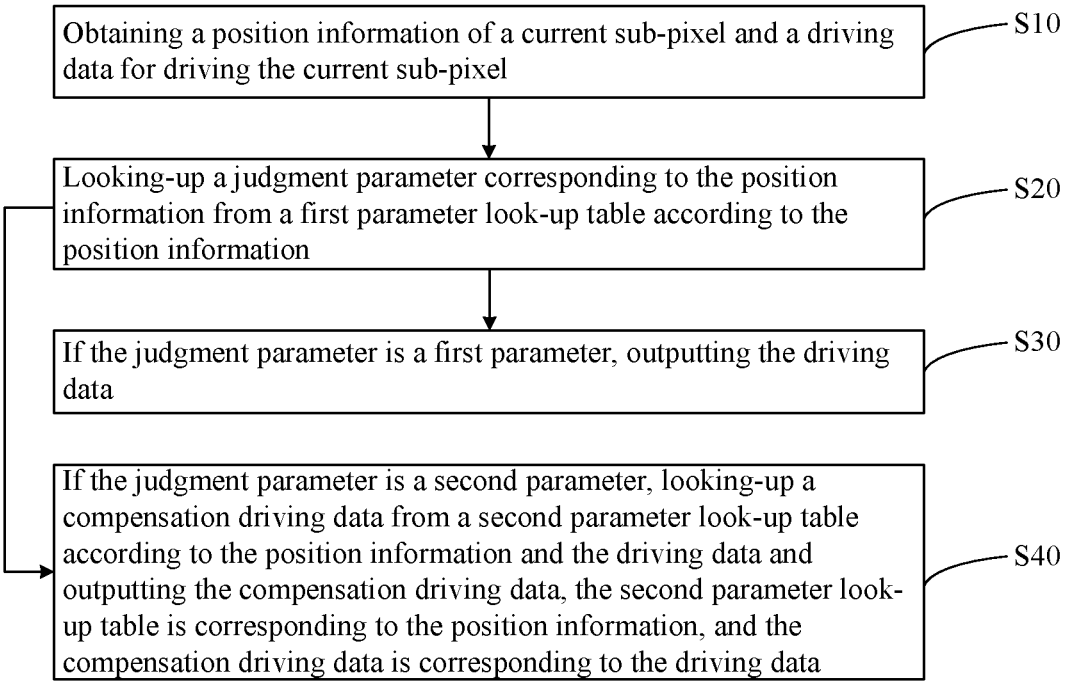
FIG. 2 is a flowchart of a driving method of a display panel according to an embodiment of the disclosure.
FIG. 3 is a schematic view of a judgment parameter look-up table according to an embodiment of the disclosure.

Referring to FIG. 2, a driving method of a display panel according to an embodiment of the disclosure includes following steps.

Step S10: obtaining position information of a current sub-pixel and a driving data used for driving the current sub-pixel.

In a specific application, the position information of the current sub-pixel specifically is a row number and a column number on which the current sub-pixel is located in the display panel. Since the color of each sub-pixel in the pixel array of the display panel is known in advance, the color of the sub-pixel can be obtained according to the position information of the sub-pixel. The driving data of the sub-pixel specifically is a data for controlling a driving voltage of the sub-pixel, and the driving data of the sub-pixel is used to realize the control of brightness of the sub-pixel. The magnitude of the driving data is positively related to the driving voltage and the brightness.

Step S20: looking-up a judgment parameter corresponding to the position information from a first parameter look-up table, according to the position information.

In a specific application, the judgment parameter is used for judging the driving data of the current sub-pixel whether needs to be compensated. If the driving data directly used to drive the sub-pixel would cause the sub-pixel being dark, it means the driving data is needed to be compensated; or else, it means the driving data does not need to be compensated.

In the illustrated embodiment, the judgment parameter specifically is a first parameter for representing the driving data needs not to be compensated or a second parameter for representing the driving data needs to be compensated.

In a specific application, the first parameter may specifically be the value of 1, and the second parameter may specifically be the value of 0. In other embodiment, the first parameter and the second parameter can be equivalently replaced by other values or functions having representation functions of equivalent meanings.

In a specific application, because display characteristic of the sub-pixel at each position in the pixel array is known in advance, the display characteristic of the sub-pixel can be obtained according to the position information of the sub-pixel, and further it is acquired that the sub-pixel whether needs to be compensated or not. In an embodiment, the judgment parameter can be found by the position information of the sub-pixel, and the first parameter look-up table is a look-up table constructed based on position information and judgment parameters of sub-pixels.

In an embodiment, the sub-pixels in the sub-pixel unit and the judgment parameters in the first parameter look-up table are corresponded in one-to-one manner as per arrangement positions, that is, the sub-pixel and the judgment parameter having the same position are mutually corresponded.

In an embodiment, the first parameter look-up table is a display look-up table (LUT). The display look-up table has a function of inputting data i.e., finding a corresponding output data according to the input data. The first parameter look-up table also may be other data table with the equivalent function or a random access memory (RAM) type storage medium.

In an embodiment, before the step S20, the driving method further includes:

preseting and storing the first parameter look-up table.

Referring to FIG. 3, an embodiment of the disclosure exemplarily illustrates a first parameter look-up table containing 2 rows×12 columns of judgment parameters. In the look-up table, R represents the red sub-pixel, G represents the green sub-pixel, B represents the blue sub-pixel, 0 represents the first parameter, and 1 represents the second parameter.

Step S30: if the judgment parameter is a first parameter, outputting the driving data.

In a specific application, the first parameter is for representing the driving data needs not to be compensated, and thus when the judgment parameter is the first parameter, it may directly output the driving data to drive the sub-pixel and at this situation it would not cause the phenomenon of sub-pixel being abnormal dark.

Step S40: if the judgment parameter is a second parameter, looking-up a compensation driving data from a second parameter look-up table according to the position information and the driving data and outputting the compensation driving data, wherein the second parameter look-up table is corresponding to the position information, and the compensation driving data is corresponding to the driving data.

In a specific application, the second parameter is for representing the driving needs to be compensated, and thus when the judgment parameter is the second parameter, the driving data is needed to be compensated and then is outputted to drive the sub-pixel so as to avoid causing the dark phenomenon of the sub-pixel.

In an embodiment, the second parameter look-up table may be a display look-up table (LUT), and also may be other data table with equivalent function or a random access memory (RAM) type storage medium.

In a specific application, by outputting the compensation driving data to drive the sub-pixel, it can solve the dark phenomenon of sub-pixel. Since the illustrated embodiment primarily is to solve the dark phenomenon of sub-pixel when a polarity inversion is occurred, and thus a value of the driving data (i.e., compensation driving data) found from the second parameter look-up table is greater than the initial value of the driving data.

In an embodiment, before the step S40, the driving method further includes:

preseting and storing the second parameter look-up table.

The illustrated embodiment obtains the position information of the current sub-pixel and the driving data for driving the current sub-pixel, finds the judgment parameter corresponding to the position information from the first parameter look-up table and determines the driving data whether needs to be compensated according to the judgment parameter. If the driving data is needed to be compensated, it will find the compensation driving data from the second parameter look-up table and output the compensation driving data. If the driving data does not need to be compensated, it will directly output the driving data without compensation. As a result, it can effectively eliminate bright and dark stripes or grid phenomenon of the liquid crystal display panel.

In an embodiment, the second parameter look-up table includes a first compensation parameter look-up table, a second compensation parameter look-up table and a third compensation parameter look-up table. Different colors of sub-pixels use different compensation parameter look-up tables.

Figures 4, 5:
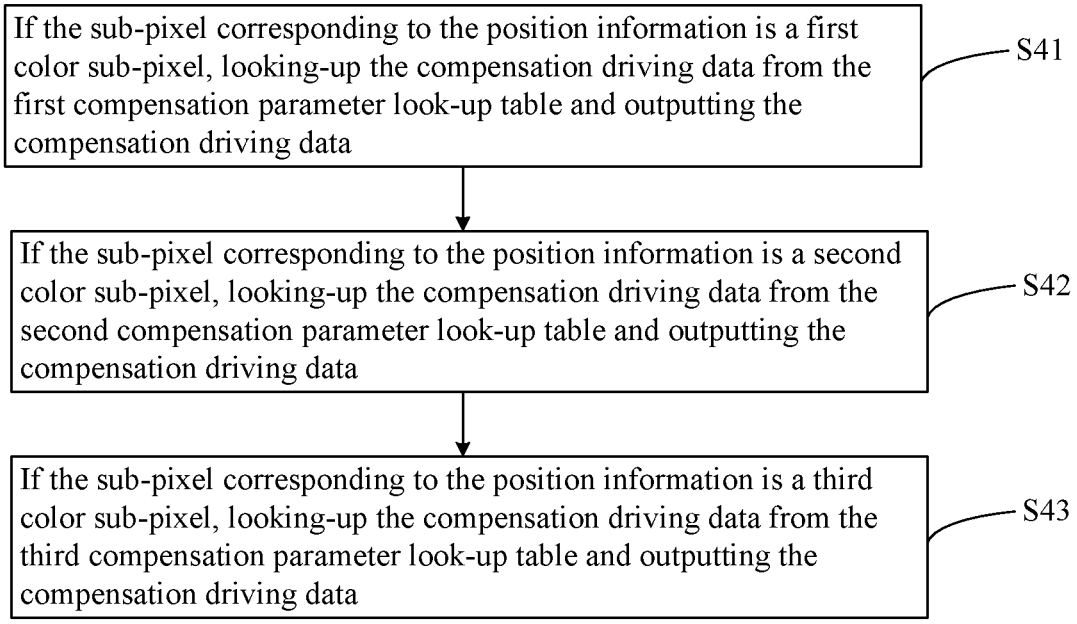
FIG. 4 is a flowchart of a step S40 according to an embodiment of the disclosure.
FIG. 5 is a schematic view of compensation parameter look-up tables according to an embodiment of the disclosure.

Referring to FIG. 4, in an embodiment of the disclosure, the step S40 specifically includes following steps.

Step S41: if the sub-pixel corresponding to the position information is a first color sub-pixel, looking-up the compensation driving data from the first compensation parameter look-up table and outputting the compensation driving data.

In an embodiment, before the step S41, it further includes:

preseting and storing the first compensation parameter look-up table.

In an embodiment, the step S41 specifically includes:

when Mod (N,3)=1, finding the compensation driving data corresponding to the driving data from the first compensation parameter look-up table, where N is the column number of the sub-pixel included in the display panel.

Step S42: if the sub-pixel corresponding to the position information is a second color sub-pixel, looking-up the compensation driving data from the second compensation parameter look-up table and outputting the compensation driving data.

In an embodiment, before the step S42, it further includes:

preseting and storing the second compensation parameter look-up table.

In an embodiment, the step S42 specifically includes:

when Mod (N,3)=2, finding the compensation driving data corresponding to the driving data from the second compensation parameter look-up table, where N is the column number of the sub-pixel included in the display panel.

Step S43: if a sub-pixel corresponding to the position information is a third color sub-pixel, looking-up the compensation driving data from the third compensation parameter look-up table and outputting the compensation driving data.

In an embodiment, before the step S43, it further includes:

preseting and storing the third compensation parameter look-up table.

In an embodiment, the step S43 specifically includes:

when Mod (N,3)=0, finding the compensation driving data corresponding to the driving data from the third compensation parameter look-up table, where N is the column number of the sub-pixel included in the display panel.

In the illustrated embodiment, the function Mod (number, divisor) represents a remainder function, where the number indicates a dividend, and the divisor indicates a divisor.

In an embodiment, the first compensation parameter look-up table, the second compensation parameter look-up table and the third compensation parameter look-up table all may be display look-up tables, and also may be other data tables with equivalent functions or random access memory type storage media.

In an embodiment, the first color sub-pixel is a red sub-pixel, the second color sub-pixel is a green sub-pixel, and the third color sub-pixel is a blue sub-pixel. The first compensation parameter look-up table is a red sub-pixel compensation parameter look-up table, the second compensation parameter look-up table is a green sub-pixel compensation parameter look-up table, and the third compensation parameter look-up table is a blue sub-pixel compensation parameter look-up table.

Referring to FIG. 5, an embodiment of the disclosure exemplarily illustrates a red sub-pixel compensation parameter look-up table R, a green sub-pixel compensation parameter look-up table G and a blue sub-pixel compensation parameter look-up table B. In the red sub-pixel compensation parameter look-up table R, numbers 0, 1, 2, . . . , 254, 255 at the top thereof represent magnitudes of driving data for sub-pixels, and R(0), R(1), R(2), . . . , R(254), R(255) at the bottom thereof represent magnitudes of compensation driving data. The green sub-pixel compensation parameter look-up table and the blue sub-pixel compensation parameter look-up table have a parameter representation rule same as that of the red sub-pixel compensation parameter look-up table.

Figure 6:
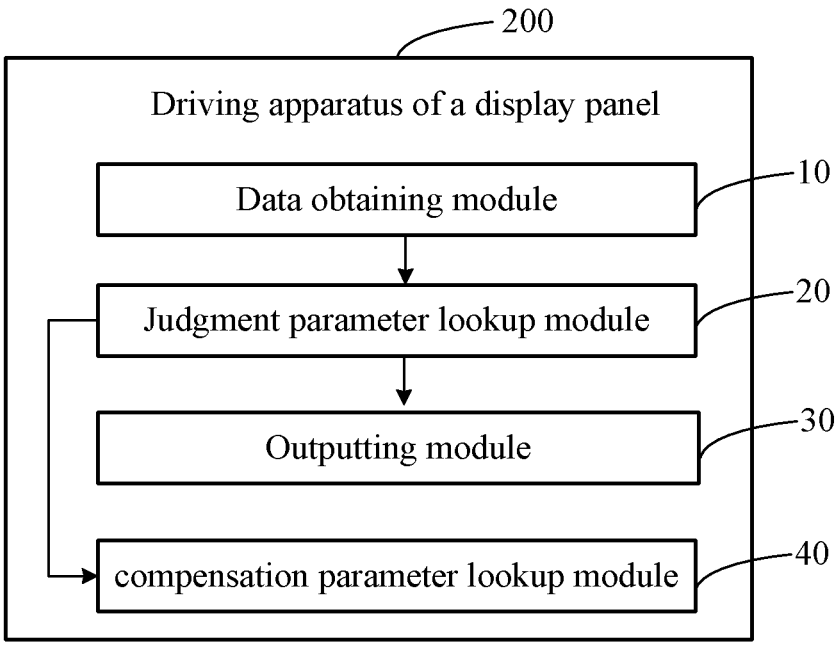
FIG. 6 is a schematic structural block diagram of a driving apparatus of a display panel according to an embodiment of the disclosure.

Referring to FIG. 6, an embodiment of the disclosure provides a driving apparatus 200 of a display panel, used for performing the driving method as shown in FIG. 2. The driving apparatus 200 includes:

a data obtaining module 10, configured (i.e., structured and arranged) to obtain position information of a current sub-pixel and a driving data used for driving the current sub-pixel;

a judgment parameter lookup module 20, configured to find a judgment parameter corresponding to the position information from a first parameter look-up table, according to the position information;

an outputting module, configured to directly output the driving data if the judgment parameter is a first parameter; and a compensation parameter lookup module 40, configured to find a compensation driving data from a second parameter look-up table according to the position information and the driving data and outputting the compensation driving data if the judgment parameter is a second parameter, wherein the second parameter look-up table is corresponding to the position information, and the compensation driving data is corresponding to the driving data.

In a specific application, the driving apparatus 200 may specifically be a software system in the source driver chip in the embodiment associated with FIG. 1.

In an embodiment, the driving apparatus 200 further includes:

a storing module, configured to preset and store the first parameter look-up table and the second parameter look-up table.

The illustrated embodiment obtains the position information of the current sub-pixel and the driving data for driving the current sub-pixel, finds the judgment parameter corresponding to the position information from the first parameter look-up table and determines the driving data whether needs to be compensated according to the judgment parameter. If the driving data is needed to be compensated, it will find the compensation driving data from the second parameter look-up table and output the compensation driving data. If the driving data does not need to be compensated, it will directly output the driving data without compensation. As a result, it can effectively eliminate bright and dark stripes or grid phenomenon of the liquid crystal display panel.

Figure 7:
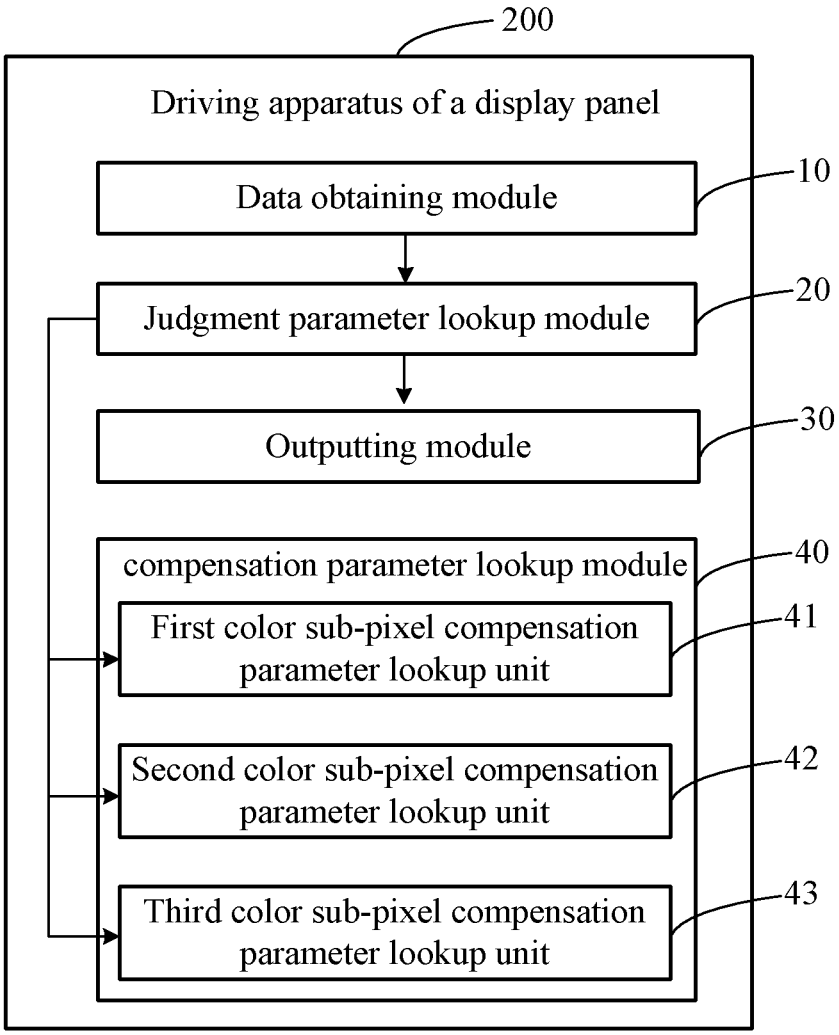
FIG. 7 is a schematic structural block diagram of a driving apparatus of a display panel according to another embodiment of the disclosure.

Referring to FIG. 7, in an embodiment of the disclosure, the compensation parameter lookup module 40 includes structures for performing the method embodiment associated with FIG. 4. In particular, it includes:

a first color sub-pixel compensation parameter lookup unit 41, configured to find the compensation driving data from the first compensation parameter look-up table if a sub-pixel corresponding to the position information is a first color sub-pixel and output the compensation driving data;

a second color sub-pixel compensation parameter lookup unit 42, configured to find the compensation driving data from the second compensation parameter look-up table if a sub-pixel corresponding to the position information is a second color sub-pixel and output the compensation driving data; and a third color sub-pixel compensation parameter lookup unit 43, configured to find the compensation driving data from the third compensation parameter look-up table if a sub-pixel corresponding to the position information is a third color sub-pixel and output the compensation driving data.

In an embodiment, the compensation parameter lookup module 40 further includes:

a first storing unit, configured to preset and store the first compensation parameter look-up table.

In an embodiment, the first color sub-pixel compensation parameter lookup unit 41 is specifically configured to:

when Mod (N,3)=1, find the compensation driving data corresponding to the driving data from the first compensation parameter look-up table, where N is the column number of the sub-pixel included in the display panel.

In an embodiment, the compensation parameter lookup module 40 further includes:

a second storing unit, configured to preset and store the second compensation parameter look-up table.

In an embodiment, the second color sub-pixel compensation parameter lookup unit 42 is specifically configured to:

when Mod (N,3)=2, find the compensation driving data corresponding to the driving data from the second compensation parameter look-up table, where N is the column number of the sub-pixel included in the display panel.

In an embodiment, the compensation parameter lookup module 40 further includes:

a third storing unit, configured to preset and store the third compensation parameter look-up table.

In an embodiment, the third color sub-pixel compensation parameter lookup unit 43 is specifically configured to:

when Mod (N,3)=0, find the compensation driving data corresponding to the driving data from the third compensation parameter look-up table, where N is the column number of the sub-pixel included in the display panel.

Figure 8:
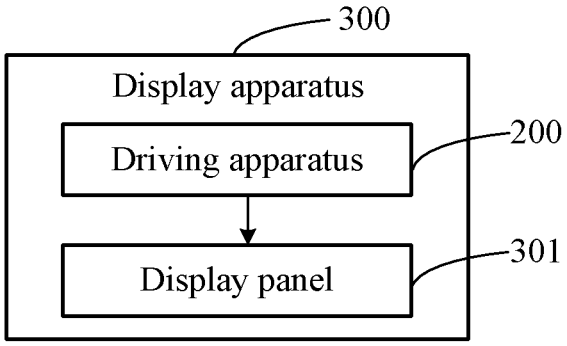
FIG. 8 is a schematic structural block diagram of a display apparatus according to an embodiment of the disclosure.

Referring to FIG. 8, an embodiment of the disclosure provides a display apparatus 300 including a display panel 301 and the above driving apparatus 200.

In an embodiment, the display panel 301 may be any type of display panel, such as a liquid crystal display panel based on LCD (liquid crystal display) technology, an organic electroluminescence display panel based on OLED (organic electroluminescence display) technology, or a quantum dot light emitting diode display panel based on QLED (quantum dot light emitting diodes) technology, or a curved display panel.

In an embodiment, all the modules or units in the embodiments of the disclosure may be realized by a general integrated circuit such as CPU (central processing unit) or an ASIC (application specific integrated circuit).

Those skilled in the art may understand that all or part of the processes for implementing the methods in the foregoing embodiments may be implemented by a computer program instructing relevant hardware. The program may be stored in a computer-readable storage medium. The program when executed by one or more processors, the process of any embodiment of the above method may be included. The storage medium may be a magnetic disk, an optical disk, a read-only memory (ROM), a random access memory (RAM), or the like.

The foregoing description is only preferred embodiments of the disclosure and is not intended to limit the disclosure. Any modifications, equivalent replacements and improvements made within the spirit and principle of the disclosure shall be included in the scope of protection of the disclosure.

What is claimed is:

1. A driving method of a display panel, comprising:

obtaining a position information of a current sub-pixel and a driving data used for driving the current sub-pixel;

looking-up a judgment parameter corresponding to the position information from a first parameter look-up table according to the position information, wherein the first parameter look-up table is a look-up table constructed based on position information and judgment parameters of sub-pixels of first through third colors;

outputting the driving data without compensation if the judgment parameter is a first parameter;

looking-up a compensation driving data from a second parameter look-up table according to the position information and the driving data and outputting the compensation driving data if the judgment parameter is a second parameter different from the first parameter, wherein the second parameter look-up table is corresponding to the position information, and the compensation driving data is corresponding to the driving data;

wherein the second parameter look-up table comprises a first compensation parameter look-up table, a second compensation parameter look-up table and a third compensation parameter look-up table respectively for sub-pixels of the first through third colors, each of the first through third compensation parameter look-up tables is consisted of magnitudes of driving data for sub-pixels and magnitudes of compensation driving data corresponding to the magnitudes of driving data in one-to-one manner, and which one of the first through third compensation parameter look-up tables is used for the looking-up of the compensation driving data is determined by the position information;

wherein the position information of the current sub-pixel is a row number and a column number on which the current sub-pixel is located in the display panel, and which one of the first through third compensation parameter look-up tables is used for the looking-up of the compensation driving data is determined by the position information as per a formula of Mod (N, 3), where N is the column number.

2. The driving method of a display panel as claimed in claim 1, wherein looking-up a compensation driving data from a second parameter look-up table according to the position information and the driving data and outputting the compensation driving data comprises:

looking-up the compensation driving data from the first compensation parameter look-up table and outputting the compensation driving data, if the sub-pixel corresponding to the position information is a sub-pixel of the first color;

looking-up the compensation driving data from the second compensation parameter look-up table and outputting the compensation driving data, if the sub-pixel corresponding to the position information is a sub-pixel of the second color;

looking-up the compensation driving data from the third compensation parameter look-up table and outputting the compensation driving data, if the sub-pixel corresponding to the position information is a sub-pixel of the third color.

3. The driving method of a display panel as claimed in claim 1, wherein the display panel comprises at least one sub-pixel unit, and each sub-pixel unit comprises m rows×n columns of sub-pixels; the at least one sub-pixel unit is regularly arranged to constitute a pixel array including M rows×N columns of sub-pixels; the first parameter look-up table is formed by m rows×n columns of judgment parameters, the sub-pixels in the sub-pixel unit are corresponding to the judgment parameters in the first parameter look-up table in one-to-one manner as per arrangement positions; where M≥m≥1, N≥n≥1, and M, N, m and n all are positive integers.

4. The driving method of a display panel as claimed in claim 3, wherein each row of sub-pixels in the pixel array comprise a plurality of groups of sub-pixels; each group of sub-pixels comprise a sub-pixel of the first color, a sub-pixel of the second color and a sub-pixel of the third color arranged in sequence; colors of the sub-pixels in a same column are the same; the sub-pixel of the first color, the sub-pixel of the second color and the sub-pixel of the third color comprise at least red sub-pixel, at least one green sub-pixel and at least one blue sub-pixel.

5. A driving apparatus of a display panel, wherein the driving apparatus comprises:

a data obtaining module, configured to obtain a position information of a current sub-pixel and a driving data used for driving the current sub-pixel;

a judgment parameter lookup module, configured to find a judgment parameter corresponding to the position information from a first parameter look-up table according to the position information, wherein the first parameter look-up table is a look-up table constructed based on position information and judgment parameters of sub-pixels of first through third colors;

an outputting module, configured to output the driving data without compensation if the judgment parameter is a first parameter;

a compensation parameter lookup module, configured to look-up a compensation driving data from a second parameter look-up table according to the position information and the driving data and outputting the compensation driving data if the judgment parameter is a second parameter different from the first parameter, wherein the second parameter look-up table is corresponding to the position information, and the compensation driving data is corresponding to the driving data;

wherein the second parameter look-up table comprises a first compensation parameter look-up table, a second compensation parameter look-up table and a third compensation parameter look-up table respectively for sub-pixels of the first through third colors, each of the first through third compensation parameter look-up tables is consisted of magnitudes of driving data for sub-pixels and magnitudes of compensation driving data corresponding to the magnitudes of driving data in one-to-one manner, and which one of the first through third compensation parameter look-up tables is used for the look-up of the compensation driving data is determined by the position information;

wherein the position information of the current sub-pixel is a row number and a column number on which the current sub-pixel is located in the display panel, and which one of the first through third compensation parameter look-up tables is used for the looking-up of the compensation driving data is determined by the position information as per a formula of Mod (N, 3), where N is the column number.

6. The driving apparatus of a display panel as claimed in claim 5, wherein the compensation parameter lookup module comprises:

a first color sub-pixel compensation parameter lookup unit, configured to look-up the compensation driving data from the first compensation parameter look-up table and outputting the compensation driving data, if the sub-pixel corresponding to the position information is a sub-pixel of the first color;

a second color sub-pixel compensation parameter lookup unit, configured to look-up the compensation driving data from the second compensation parameter look-up table and outputting the compensation driving data, if the sub-pixel corresponding to the position information is a sub-pixel of the second color;

a third color sub-pixel compensation parameter lookup unit, configured to look-up the compensation driving data from the third compensation parameter look-up table and outputting the compensation driving data, if the sub-pixel corresponding to the position information is a sub-pixel of the third color.

7. The driving apparatus of a display panel as claimed in claim 5, wherein the display panel comprises at least one sub-pixel unit, and each sub-pixel unit comprises m rows×n columns of sub-pixels; the at least one sub-pixel unit is regularly arranged to constitute a pixel array including M rows×N columns of sub-pixels; the first parameter look-up table is formed by m rows×n columns of judgment parameters, the sub-pixels in the sub-pixel unit are corresponding to the judgment parameters in the first parameter look-up table in one-to-one manner as per arrangement positions; where M≥m≥1, N≥n≥1, and M, N, m and n all are positive integers.

8. The driving apparatus of a display panel as claimed in claim 7, wherein each row of sub-pixels in the pixel array comprise a plurality of groups of sub-pixels; each group of sub-pixels comprise a sub-pixel of the first color, a sub-pixel of the second color and a sub-pixel of the third color arranged in sequence; colors of the sub-pixels in a same column are the same; the sub-pixel of the first color, the sub-pixel of the second color and the sub-pixel of the third color comprise at least red sub-pixel, at least one green sub-pixel and at least one blue sub-pixel.

9. A display apparatus, wherein the display apparatus comprises:

a display panel; and a driving apparatus; wherein the driving apparatus comprises a processor and a memory storing instructions which when executed by the processor, cause the driving apparatus to perform a driving method comprising:

obtaining a position information of a current sub-pixel and a driving data used for driving the current sub-pixel;

looking-up a judgment parameter corresponding to the position information from a first parameter look-up table according to the position information, wherein the first parameter look-up table is a look-up table constructed based on position information and judgment parameters of sub-pixels of first through third colors;

outputting the driving data without compensation if the judgment parameter is a first parameter;

looking-up a compensation driving data from a second parameter look-up table according to the position information and the driving data and outputting the compensation driving data if the judgment parameter is a second parameter different from the first parameter, wherein the second parameter look-up table is corresponding to the position information, and the compensation driving data is corresponding to the driving data;

wherein the second parameter look-up table comprises a first compensation parameter look-up table, a second compensation parameter look-up table and a third compensation parameter look-up table respectively for sub-pixels of the first through third colors, each of the first through third compensation parameter look-up tables is consisted of magnitudes of driving data for sub-pixels and magnitudes of compensation driving data corresponding to the magnitudes of driving data in one-to-one manner, and which one of the first through third compensation parameter look-up tables is used for the looking-up of the compensation driving data is determined by the position information;

wherein the position information of the current sub-pixel is a row number and a column number on which the current sub-pixel is located in the display panel, and which one of the first through third compensation parameter look-up tables is used for the looking-up of the compensation driving data is determined by the position information as per a formula of Mod (N, 3), where N is the column number.

10. The display apparatus as claimed in claim 9, wherein looking-up a compensation driving data from a second parameter look-up table according to the position information and the driving data and outputting the compensation driving data comprises:

looking-up the compensation driving data from the first compensation parameter look-up table and outputting the compensation driving data, if the sub-pixel corresponding to the position information is a sub-pixel of the first color;

looking-up the compensation driving data from the second compensation parameter look-up table and outputting the compensation driving data, if the sub-pixel corresponding to the position information is a sub-pixel of the second color;

looking-up the compensation driving data from the third compensation parameter look-up table and outputting the compensation driving data, if the sub-pixel corresponding to the position information is a sub-pixel of the third color.

11. The display apparatus as claimed in claim 9, wherein the display panel comprises at least one sub-pixel unit, and each sub-pixel unit comprises m rows×n columns of sub-pixels; the at least one sub-pixel unit is regularly arranged to constitute a pixel array including M rows×N columns of sub-pixels; the first parameter look-up table is formed by m rows×n columns of judgment parameters, the sub-pixels in the sub-pixel unit are corresponding to the judgment parameters in the first parameter look-up table in one-to-one manner as per arrangement positions; where $M \geq m \geq 1$, $N \geq n \geq 1$, and M, N, m and n all are positive integers.

12. The display apparatus as claimed in claim 11, wherein each row of sub-pixels in the pixel array comprise a plurality of groups of sub-pixels; each group of sub-pixels comprise a sub-pixel of the first color, a sub-pixel of the second color and a sub-pixel of the third color arranged in sequence; colors of the sub-pixels in a same column are the same; the sub-pixel of the first color, the sub-pixel of the second color and the sub-pixel of the third color comprise at least red sub-pixel, at least one green sub-pixel and at least one blue sub-pixel.

* * * * *